US010483688B2

(12) United States Patent
Wrisley et al.

(10) Patent No.: US 10,483,688 B2
(45) Date of Patent: Nov. 19, 2019

(54) MAGNETICALLY ACTIVATED LATCH MECHANISM

(71) Applicant: Microsoft Technology Licensing, LLC, Redmond, WA (US)

(72) Inventors: Kurt David Wrisley, Edmonds, WA (US); Akash Atul Shah, Seattle, WA (US); Christopher Alan Schafer, Redmond, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 0 days.

(21) Appl. No.: 15/987,864

(22) Filed: May 23, 2018

(65) Prior Publication Data

US 2018/0375251 A1 Dec. 27, 2018

Related U.S. Application Data

(60) Provisional application No. 62/519,644, filed on Jun. 14, 2017.

(51) Int. Cl.
*H01R 13/60* (2006.01)
*H01R 13/62* (2006.01)
(Continued)

(52) U.S. Cl.
CPC ..... *H01R 13/6205* (2013.01); *H01R 11/30* (2013.01); *H01R 13/24* (2013.01);
(Continued)

(58) Field of Classification Search
CPC .... H01R 13/6205; H01R 13/24; H01R 11/30; H01R 13/6271; H01R 13/665; H01R 13/64; H01R 13/703; G02B 6/36
(Continued)

(56) References Cited

U.S. PATENT DOCUMENTS 5,921,783 A * 7/1999 Fritsch ..... H01R 13/703 439/38
6,183,264 B1 2/2001 Harsanyi
(Continued)

OTHER PUBLICATIONS

Irving, Michael, "Magnetic USB-C adapter provides power, data and video", http://newatlas.com/magneo-usbc-magnetic-adapter/47096/, Published on: Dec. 23, 2016, 16 pages.

*Primary Examiner* — Jean F Duverne
(74) *Attorney, Agent, or Firm* — Ray Quinney & Nebeker P.C.; Paul N. Taylor

(57) ABSTRACT

A magnetic receptacle is described. The receptacle includes an electronic connector having an engagement feature on one or more sides of the electronic connector. The engagement feature is configured to engage a latching feature on a magnetic protrusion. The receptacle includes one or more receptacle magnets positioned adjacent the magnetic receptacle configured to deactivate the latching feature on the magnetic protrusion. In one implementation, a magnetic plug is described. The plug includes a plug tip. The plug includes one or more latching features. The plug includes one or more plug magnets positioned adjacent the plug tip. The one or more plug magnets are configured to cooperate with one or more receptacle magnets to transition the one or more latching features between an engaged state and a disengaged state.

20 Claims, 5 Drawing Sheets

(51) Int. Cl.

| | |
|---|---|
| ***H01R 13/24*** | (2006.01) |
| ***H01R 11/30*** | (2006.01) |
| ***H01R 13/627*** | (2006.01) |
| ***H01R 13/66*** | (2006.01) |
| ***H01R 13/64*** | (2006.01) |
| *H01R 24/60* | (2011.01) |
| *H01R 107/00* | (2006.01) |

(52) U.S. Cl.
CPC ..... *H01R 13/6271* (2013.01); *H01R 13/6273* (2013.01); *H01R 13/64* (2013.01); *H01R 13/665* (2013.01); *H01R 24/60* (2013.01); *H01R 2107/00* (2013.01)

(58) Field of Classification Search
USPC ..... 439/39
See application file for complete search history.

(56) References Cited

U.S. PATENT DOCUMENTS

| | | | | |
|---|---|---|---|---|
| 6,267,602 | B1 * | 7/2001 | Mendelson | H01R 13/6205 439/38 |
| 7,311,526 | B2 | 12/2007 | Rohrbach et al. | |
| 7,329,128 | B1 | 2/2008 | Awad | |
| 7,625,212 | B2 * | 12/2009 | Du | H01R 13/6205 439/39 |
| 8,105,091 | B2 * | 1/2012 | Nishihira | H01R 13/6205 439/39 |
| 8,320,525 | B2 * | 11/2012 | Khouri | A61B 6/4233 250/370.09 |
| 9,112,303 | B2 | 8/2015 | Zeliff et al. | |
| 9,287,665 | B2 | 3/2016 | Watanabe | |
| 9,316,795 | B2 | 4/2016 | Lee | |
| 9,500,817 | B2 * | 11/2016 | Coffey | G02B 6/36 |
| 9,632,535 | B2 * | 4/2017 | Carnevali | G06F 1/181 |

* cited by examiner

MAGNETICALLY ACTIVATED LATCH MECHANISM

CROSS-REFERENCE TO RELATED APPLICATIONS

This application claims the benefit of U.S. Provisional Patent Application No. 62/519,644, filed on Jun. 14, 2017, which is hereby incorporated by reference in its entirety.

BACKGROUND

Background and Relevant Art

Use of computing devices is becoming more ubiquitous by the day. Computing devices range from standard desktop computers to wearable computing technology and beyond. Computing devices include various types of communication devices that can be used to connect a computing device with other computing devices and/or accessories.

The subject matter claimed herein is not limited to implementations that solve any disadvantages or that operate only in environments such as those described above. Rather, this background is only provided to illustrate one exemplary technology area where some implementations described herein may be practiced.

BRIEF SUMMARY

In one implementation, a magnetic receptacle is described. The receptacle includes an electronic connector having an engagement feature on one or more sides of the electronic connector. The engagement feature is configured to engage a latching feature on a magnetic protrusion. The receptacle includes one or more receptacle magnets positioned adjacent the magnetic receptacle configured to deactivate the latching feature on the magnetic protrusion.

In one implementation, a magnetic plug is described. The plug includes a plug tip. The plug includes one or more latching features. The plug includes one or more plug magnets positioned adjacent the plug tip. The one or more plug magnets are configured to cooperate with one or more receptacle magnets to transition the one or more latching features between an engaged state and a disengaged state.

In one implementation, a system includes a magnetic receptacle and a magnetic plug. The magnetic receptacle includes an electronic connector having an engagement feature on one or more sides of the electronic connector. The magnetic receptacle includes one or more receptacle magnets positioned adjacent the magnetic receptacle. The magnetic plug including a plug tip. The magnetic plug includes one or more latching features. The magnetic plug includes one or more plug magnets positioned adjacent the plug tip. The one or more plug magnets configured to cooperate with the one or more receptacle magnets to transition the one or more latching features on the magnetic plug between a friction state and a free state.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages will be set forth in the description which follows, and in part will be obvious from the description, or may be learned by the practice of the teachings herein. Features and advantages of the disclosure may be realized and obtained by means of the instruments and combinations particularly pointed out in the appended claims. Features of the present disclosure will become more fully apparent from the following description and appended claims, or may be learned by the practice of the disclosure as set forth hereinafter.

BRIEF DESCRIPTION OF THE DRAWINGS

In order to describe the manner in which the above-recited and other features of the disclosure can be obtained, a more particular description will be rendered by reference to specific implementations thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example implementations, the implementations will be described and explained with additional specificity and detail through the use of the accompanying drawings in which:

FIGS. 3-1 and 3-2 are cutaway schematic top views of an implementation of a magnetic receptacle and an implementation of a magnetic plug, according to a second implementation of the present disclosure;

FIG. 4-1 is a cutaway schematic top view of an implementation of a magnetic receptacle and an implementation of a magnetic plug, according to a third implementation of the present disclosure;

FIG. 4-2 is a cutaway schematic top view of the implementation of a magnetic receptacle in FIG. 4-1 and the implementation of the magnetic plug of FIG. 4-1, according to the third implementation of the present disclosure;

FIG. 5-1 is a cutaway schematic top view of an implementation of a magnetic receptacle and an implementation of a magnetic plug, according to a fourth implementation of the present disclosure;

FIG. 5-2 is a cutaway schematic top view of the implementation of a magnetic receptacle in FIG. 4-1 and the implementation of the magnetic plug of FIG. 4-1, according to the fourth implementation of the present disclosure;

DETAILED DESCRIPTION

Figure 1:
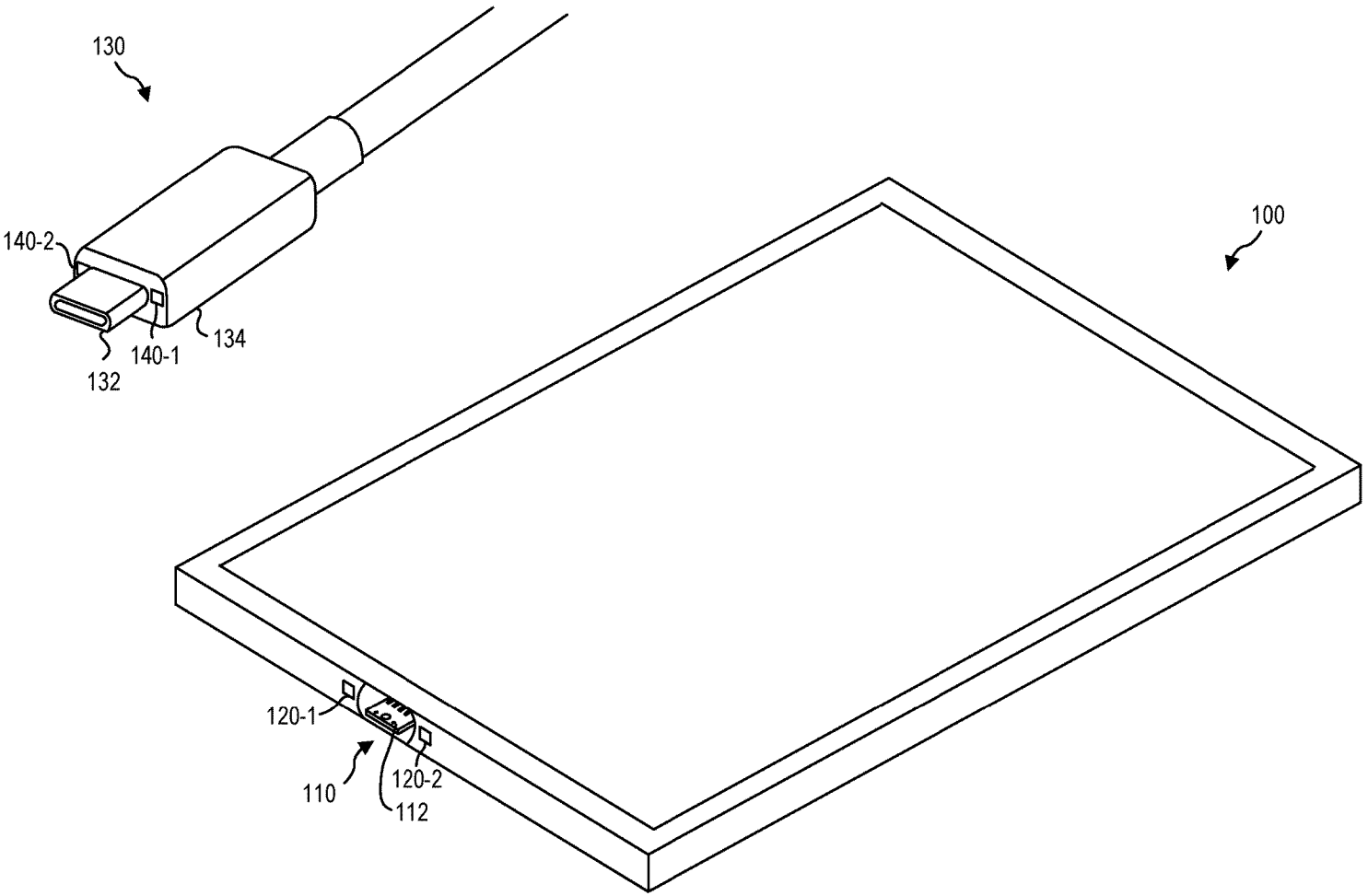
FIG. 1 is an isometric separated view of a computing device and a magnetic plug, according to an implementation of the present disclosure.

This disclosure generally relates to data connectors, systems, and methods of use and manufacturing. More particularly, this disclosure generally relates to magnetically activated latch mechanisms, systems, and methods of use and manufacturing.

Latch mechanisms are used widely in mechanical and electromechanical assemblies. They can help align and hold together disjoint parts that may need to attach and detach multiple times as the system is used.

In some implementations, the latch mechanisms may include a USB-C connection. The latch mechanisms may involve interference between the two disjoint parts (e.g., receptacles and plugs) that needs to be overcome during attach and detach. Such interference may provide for a "friction experience" which can occur over a short amount of distance, time of insertion, time of extraction, or combinations thereof. In some implementations, to achieve this interference, the two disjoint parts may be manually aligned and pushed together. The "friction experience" of the latch mechanism may limit the ability of the system (in the joined state) to easily respond to unexpected forces. For example, forces that do not act along the insertion/extraction axis may be less responsive. At least one implementation may use magnetism to create a natural tendency in these disjoint parts to align and settle in the final joint position. The "magnetic experience" may allows two parts to snap together even when they are a relatively large distance away, without any external fore; and/or may allow the two to detach under a wider range of external forces (without any damage to the system).

In some implementations, the distance between the two parts before the parts are drawn together may have an upper value, a lower value, or upper and lower values including 4.0 mm, 10.0 mm, 15.0 mm, 25.0 mm, or any value therebetween. In some implementations, it may be critical that the distance be greater than 4.0 mm. In some implementations, a minimum distance may be greater than an engagement depth of the receptacle. In other words, the distance may be sufficiently small such that an activation mechanism is activated before one part enters another part.

At least one implementation described herein may create a significant improvement over traditional latch mechanisms by enabling them to have an improved "magnetic experience" when two magnetic disjoint parts are used together. Additionally, in at least one implementation, the two magnetic disjoint parts are fully compatible with their individually corresponding standard disjoint parts: providing a "friction experience". In at least one implementation, the disjoint parts are capable of having a magnetic experience and are capable of having a friction experience when one disjoint part is used with a standard disjoint part. In at least one implementation, a USB-C receptacle and/or a USB-C plug may provide a "magnetic experience"

A "magnetic experience" may include disabling a friction element used for a "friction experience," such that the disjoint parts magnetically connect. In at least one implementation, the friction element is a latching feature of a USB-C plug. A "friction experience" may include a latching feature of a USB-C plug engaging a tongue of a USB-C receptacle with a latching feature.

USB-C is the new industry standard that is being adopted by most consumer electronic products; this connector relies on the traditional "friction experience" attach and detach. This may degrade the consumer experience when compared with one or more implementations of the magnetic connectors. Magnetic connection can offer an improved user insertion experience by reducing the required insertion force and minimizing the effort required to align the plug and receptacle. Magnetic connectors also may allow the user's device to be protected from harm even when someone trips on the cable hanging from the device. At least one implementation described herein facilitates the creation of custom USB-C receptacles and plugs that provide "magnetic experiences" when used together, and "friction experiences" when used with standard plugs and receptacles.

Previous solutions have involved either replacing the entire latch mechanism with custom parts (e.g., with different alignment and/or retention features) that may make the mechanism incompatible with existing or industry standard parts or using a replaceable adapter on either side of the latched parts to create a custom receptacle and plug/latch combination which requires additional parts and learning (for the adapter).

In at least one implementation, when a plug and a receptacle are brought within proximity to each other, magnets on the receptacle side activate a magnet-based mechanism on the plug side. In at least one implementation, a latching feature actuator may disable latching features that provide a "friction experience", and the result is a "magnetic experience". When a standard plug or receptacle is used with one or more implementations of a receptacle of the present disclosure, the magnets on the receptacle side may not provide any input, and the standard "friction experience" is felt by the user. When one or more implementations of a plug of the present disclosure are inserted into a standard receptacle, the mechanism may not be activated, and the user may feel the standard "friction experience".

The following description provides implementations that achieve one or more of these requirements:

FIG. 1 is an isometric separated view of a computing device 100 and a magnetic plug 130 (e.g., a magnetic protrusion), according to an implementation of the present disclosure. The computing device 100 may include a magnetic receptacle 110 and a magnetic plug 130. In some implementations, the computing device 100 may include only one magnetic connector, such as a magnetic receptacle 110 and a standard plug or a standard receptacle and a magnetic plug 130. For purposes of illustration, the connectors shown with the computing device 100 will be described as being a magnetic receptacle 110 and a magnetic plug 130.

The magnetic receptacle 110 may include one or more receptacle magnets 120 and is shown with two receptacle magnets 120. The receptacle magnets 120 are shown on the left and right side of the magnetic receptacle 110. This may be due to the overall thickness of the computing device 100. In implementations where the thickness of the computing device 100 allows for it, one or more receptacle magnets 120 may be placed above and/or below the magnetic receptacle 110. Thus, receptacle magnets 120 may be placed on the left of the magnetic receptacle 110, the right of the magnetic receptacle 110, the top of the magnetic receptacle 110, the bottom of the magnetic receptacle 110, behind the magnetic receptacle 110, or combinations thereof.

As shown, the magnetic receptacle 110 may be a magnetic USB-C receptacle and the magnetic plug 130 may be a magnetic USB-C plug. In other implementations, the magnetic receptacle 110 and magnetic plug 130 may be another type of magnetic receptacle.

The magnetic receptacle 110 may include an electronic connector 112. In implementations where the magnetic receptacle 110 is a magnetic USB-C receptacle, the electronic connector 112 may be a USB-C Printed Circuit Board (PCB) tongue. In other implementations, the electronic connector 112 may simply be a plastic tongue with metal contacts assembled and/or molded in it. The electronic connector 112 may include one or more receptacle electronic connections (not labeled) to facilitate data and/or power communication between the magnetic receptacle 110 and the magnetic plug 130.

The magnetic plug 130 may include one or more plug magnets 140 and is shown with two plug magnets 140. The number of receptacle magnets 120 and plug magnets 140 may be the same (e.g., two receptacle magnets 120 and two plug magnets 140). In other implementations, the number of receptacle magnets 120 and plug magnets 140 may be different.

The receptacle magnets 120 and/or plug magnets 140 may include permanent magnets and/or electromagnets. The receptacle magnets 120 and/or plug magnets 140 may be formed of various magnetic materials. The magnetic materials may include ferromagnetic materials, rare-earth magnets, or other types of magnets. In most implementations, the magnetic material may be neodymium ferrite boron (NdFeB).

The receptacle magnets 120 and/or plug magnets 140 may each generate a magnetic force. In some implementations, a lower value of the magnetic force generated may be greater than the opposing forces created due to the weight of the magnetic plug 130. For example, the magnetic force may have an upper value, a lower value, or upper and lower values including 1.0 Newtons (N), 2.0 N, 4.0 N, 8.0 N, 12.0 N, 24.0 N, or any value therebetween. In some implementations, it may be critical that the magnetic force be greater than 2.0 N.

The magnetic plug 130 may include a plug tip 132 and a housing 134 (e.g., overmold). The plug tip 132 may include one or more plug electronic connections (not labeled) to facilitate data and/or power communication between the magnetic plug 130 and the magnetic receptacle 110. For example, the one or more plug electronic connections (e.g., within the plug tip 132) may be in electronic communication with the one or more receptacle electronic connections (e.g., on the electronic connector 112), when the plug tip (e.g., a standard plug tip or a magnetic plug tip 132) is at least partially inserted into the receptacle (e.g., a standard receptacle or a magnetic receptacle 110).

The housing 134 may abut the plug tip 132. The housing 134 may encapsulate one or more electrical and/or mechanical components of the magnetic plug 130. As shown, the housing 134 may be larger (e.g., have one or more larger dimensions) than the plug tip 132. For example, the housing 134 may be wider (e.g., from left to right on the page) than the plug tip 132. In another example, the housing 134 may be thicker (e.g., from top to bottom on the page) than the plug tip 132. In a further example, the housing 134 may be longer (e.g., from the plug tip 132 toward the cable (not labeled)) than the plug tip 132.

Having a larger housing 134 than the plug tip 132 may allow for one or more plug magnets 140 to be included in the magnetic plug 130 that can interact with one or more receptacle magnets 120 as will be described in more detail below. In some implementations, the plug magnets 140 may be located behind the plug tip 132 such that the housing 134 and the plug tip 132 may have two or more similar or same dimensions. Thus, plug magnets 140 may be placed on the left of the plug tip 132, the right of the plug tip 132, the top of the plug tip 132, the bottom of the plug tip 132, behind the plug tip 132, or combinations thereof.

The magnetic plug 130 may be inserted into the magnetic receptacle 110. As the magnetic plug 130 gets closer to the magnetic receptacle 110, magnetic fields from the receptacle magnets 120 and the plug magnets 140 may draw the magnetic plug 130 toward the magnetic receptacle 110. Drawing the magnetic plug 130 toward the magnetic receptacle 110 may include aligning the magnetic plug 130 so that it can be drawn into the magnetic receptacle 110 or simply drawing the magnetic plug 130 into the magnetic receptacle 110. Orientations of poles of the receptacle magnets 120 and/or the plug magnets 140 may facilitate aligning and/or drawing the magnetic plug 130 with and/or into the magnetic receptacle 110.

As the magnetic plug 130 gets closer to the magnetic receptacle 110, magnetic fields from the receptacle magnets 120 and the plug magnets 140 may activate a latching feature actuator, as will be described in more detail below. Activating a latching feature actuator may move one or more latching features within the magnetic receptacle 110 and/or magnetic plug 130 to create a "magnetic experience" without a "friction experience". In one or more implementations where only one of the plug or receptacle is a magnetic plug 130 or magnetic receptacle 110, the latching feature activator may not be actuated and the plug and/or receptacle experiences only a "friction experience."

Figure 2:
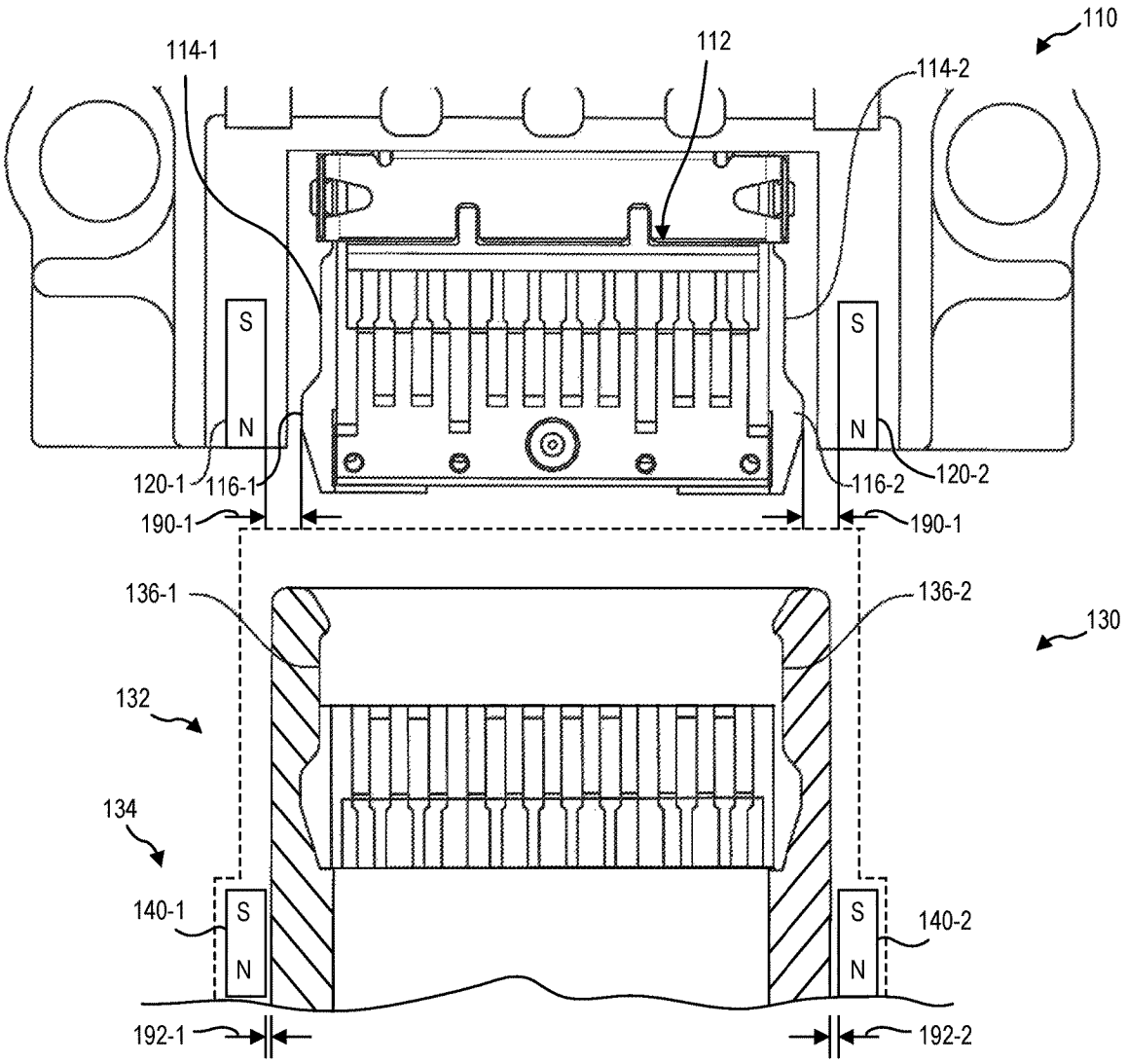
FIG. 2 is a cutaway top view of the implementation of a magnetic receptacle and the implementation of a magnetic plug, according to the implementation of FIG. 1.

FIG. 2 is a cutaway top view of the implementation of a magnetic receptacle 110 and the implementation of a magnetic plug 130, according to the implementation of FIG. 1. The magnetic receptacle 110 may be connected to the computing device (e.g., computing device 100). As shown, the magnetic receptacle 110 may include connection features that may be fastened to the computing device. In other implementations, the magnetic receptacle 110 may be otherwise fastened. For example, the magnetic receptacle 110 may be integrally formed with a housing of the computing device.

The electronic connector 112 may include one or more engagement features 114 on a side of the electronic connector 112. The plug tip 132 of the magnetic plug 130 may include one or more latching features 136 (e.g., first and second latching features 136-1, 136-2). The latching features 136 may be configured to engage the engagement features 114 (e.g., first and second engagement features 114-1, 114-2). However, in one or more implementations where the receptacle and plug are a magnetic receptacle 110 and a magnetic plug 130, respectively, the latching features 136 may not engage the engagement features 114.

The magnetic receptacle 110 is shown with a first receptacle magnet 120-1 and a second receptacle magnet 120-2. The first receptacle magnet 120-1 may be spaced a first distance 190-1 from a side 116-1 of the electronic connector 112. The second receptacle magnet 120-2 may be spaced a second distance 190-2 from a side 116-1 of the electronic connector 112.

The magnetic plug 130 is shown with a first plug magnet 140-1 and a second plug magnet 140-2 within the housing 134. The first plug magnet 140-1 may be spaced a first distance 192-1 from the first latching feature 136-1. The second plug magnet 140-2 may be spaced a second distance 192-2 from the second latching feature 136-2. The distances 190 between the receptacle magnets 120 and/or the distances 192 between the plug magnets 140 may be selected to align the receptacle magnets 120 and the plug magnets 140 in a plugged state. An aligned receptacle magnet 120 and plug magnet 140 may include positioning that allows the magnetic fields generated by the receptacle magnet 120 and plug magnet 140 to align the magnetic plug 130 with and/or insert the magnetic plug 130 into the magnetic receptacle 110.

The first distance 190-1 and the second distance 190-2 may be the same. In other implementations, first distance 190-1 and the second distance 190-2 may be different. The first distance 192-1 and the second distance 192-2 may be the same. In other implementations, first distance 192-1 and the second distance 192-2 may be different. It may be desirable, in some implementations, that the distances 192 be smaller, such that the plug magnets 140 may fit within the housing 134 without making the housing significantly larger than a standard housing. For example, the housing 134 may have the same width and thickness dimensions as a standard USB-C plug while still fitting the plug magnets 140 within the housing 134.

The distances 190 may have an upper value, a lower value, or upper and lower values including 0.825 mm, 1.0 mm, 2.0 mm, 3.0 mm, 4.0 mm, 5.0 mm, or any value therebetween. In some implementations, it may be critical that the distance be less than 2.0 mm.

The distances 192 may have an upper value, a lower value, or upper and lower values including 0.0 mm, 0.25 mm, 0.5 mm, 0.75 mm, 1.0 mm, 2.0 mm, 3.0 mm, 4.0 mm, 5.0 mm, or any value therebetween. In some implementations, it may be critical that the distance be less than 5.0 mm.

The receptacle magnets 120 may have the same polarity. In other words, an outer pole (e.g., nearest the plug) of the first receptacle magnet 120-1 may have the same polarity as an outer pole of the second receptacle magnet 120-2. The plug magnets 140 may have the same polarity. In other words, an outer pole (e.g., nearest the receptacle) of the first plug magnet 140-1 may have the same polarity as an outer pole of the second plug magnet 140-2. As shown, the receptacle magnets 120 may have the same polarity and the plug magnets 140 may all have the same polarity, with each receptacle magnet 120 opposing each corresponding plug magnet 140. In other words, an outer pole (e.g., nearest the plug) of the first receptacle magnet 120-1 may have the opposite polarity as an outer pole (e.g., nearest the receptacle) of the first plug magnet 140-1 and an outer pole of the second receptacle magnet 120-2 may have the opposite polarity as an outer pole of the second plug magnet 140-2, such that the first receptacle magnet 120-1 and the first plug magnet 140-1 and the second receptacle magnet 120-2 and the second plug magnet 140-2 are attracted. In other implementations, one or more receptacle magnets 120 and/or one or more plug magnets 140 may vary in any combination so long as the receptacle magnets 120 and the plug magnets 140 are generally attracted to one another.

Figures 2, 3:
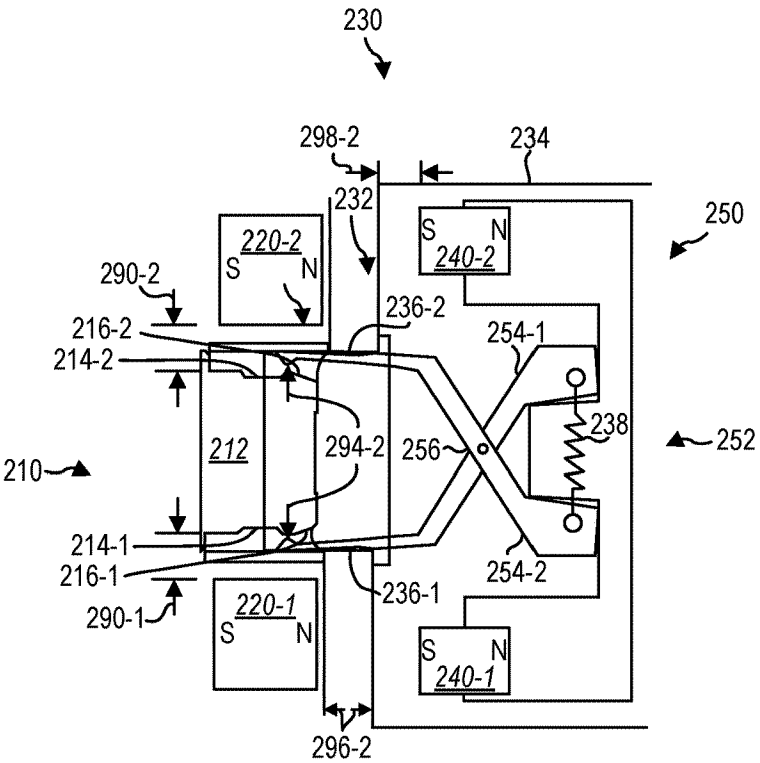
Figures 1, 3:
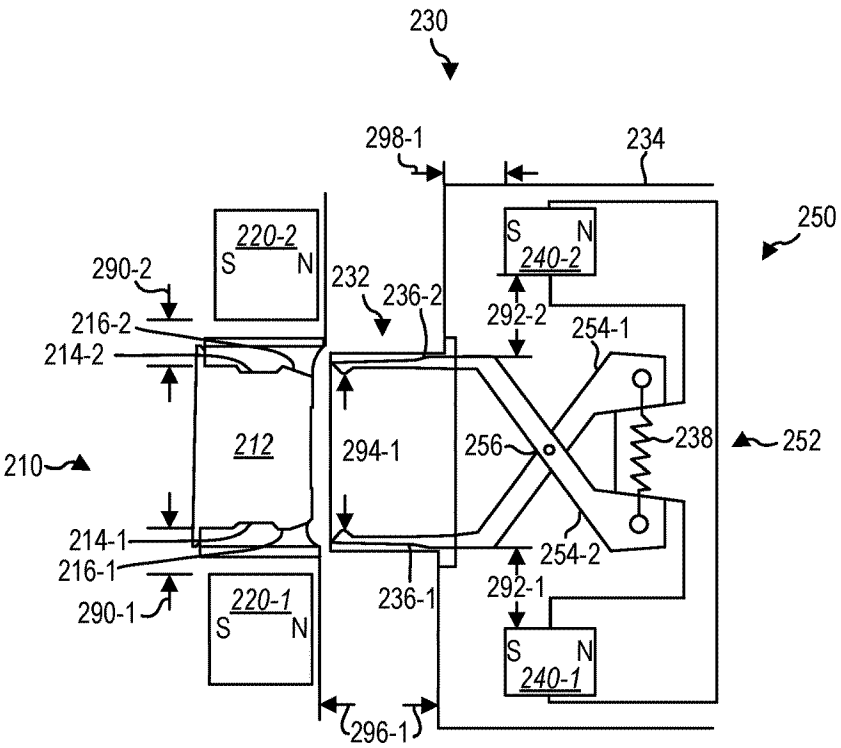

FIGS. 3-1 and 3-2 are cutaway schematic top views of an implementation of a magnetic receptacle 210 and an implementation of a magnetic plug 230, according to a second implementation of the present disclosure. FIG. 3-1 illustrates the magnetic plug 230 in an engaged state and FIG. 3-2 illustrates the magnetic plug 230 in a disengaged state. Referring generally to FIGS. 3-1 and 3-2, the magnetic receptacle 210 may be used with the computing device 100.

The magnetic receptacle 210 may include an electronic connector 212 and one or more receptacle magnets 220. The electronic connector 212 puts the magnetic receptacle 210 in data and/or power communication with a computing device (e.g., computing device 100). The electronic connector 212 may include one or more engagement features 214. The engagement features 214 may be configured to facilitate a "friction experience" with a standard plug.

The magnetic plug 230 may include a plug tip 232 with one or more electrical connections (not labeled) to put the plug tip 232 in electrical and/or power communication with the magnetic receptacle 210 (or a standard receptacle). The magnetic plug 230 may include a housing 234 that encapsulates one or more electrical and/or mechanical components of the magnetic plug 230.

The plug tip 232 may include one or more latching features 236. The latching features 236 may be configured to facilitate a "friction experience" with a standard receptacle.

The housing 234 may house one or more plug magnets 240. The one or more plug magnets 240 may be connected to a latching feature actuator 250. The latching feature actuator 250 may move the one or more latching features 236 toward and/or to a disengaged state (e.g., as shown in FIG. 3-2). In the disengaged state, the one or more latching features 236 may be moved so that they do not engage the one or more engagement features 214 when inserted.

The one or more receptacle magnets 220 may be separated from a side 216 of an engagement feature 214 of the electronic connector 212 by a distance 290. As shown, the first receptacle magnet 220-1 may be spaced a first distance 290-1 from a side 216-1 of the electronic connector 212. The second receptacle magnet 220-2 may be spaced a second distance 290-2 from a side 216-1 of the electronic connector 212.

The one or more plug magnets 240 may be separated from the one or more latching features 236 by a distance 292. As shown, the first plug magnet 240-1 may be spaced a first distance 292-1 from the first latching feature 236-1. The second plug magnet 240-2 may be spaced a second distance 292-2 from the second latching feature 236-2.

As described above, the distances 290 between the receptacle magnets 220 and/or the distances 292 between the plug magnets 240 may be selected to align the receptacle magnets 220 and the plug magnets 240 in a plugged state (e.g., when the magnet plug 230 is inserted into the magnet receptacle 210).

The first distance 290-1 and the second distance 290-2 may be the same. In other implementations, first distance 290-1 and the second distance 290-2 may be different. The first distance 292-1 and the second distance 292-2 may be the same. In other implementations, first distance 292-1 and the second distance 292-2 may be different. The distances 290 may have one or more of the values associated with distances 190. The distances 292 may have one or more of the values associated with distances 192.

As shown in FIG. 3-1, the latching features 236 may be in an engaged state at a distance 296-1 between an outer surface of the magnetic receptacle 210 and a base of the plug tip 232. As shown in FIG. 3-2, the latching features 236 may be in a disengaged state at a distance 296-2 between the outer surface of the magnetic receptacle 210 and the base of the plug tip 232. The distance 296 may include an engaged distance, a disengaged distance, and distances where the latching feature actuator 250 transitions between the engaged and disengaged states.

The engaged distance may include an upper value, a lower value, or upper and lower values including 4.0 mm, 10.0 mm, 15.0 mm, 25.0 mm, or any value therebetween. In some implementations, it may be critical that the distance be greater than 4.0 mm. The disengaged distance may include an upper value, a lower value, or upper and lower values including 4.0 mm, 10.0 mm, 15.0 mm, 25.0 mm, or any value therebetween. In some implementations, it may be critical that the distance be less than 25.0 mm.

The transition distance may include an upper value, a lower value, or upper and lower values including 4.0 mm, 10.0 mm, 15.0 mm, 25.0 mm or any value therebetween. In some implementations, it may be critical that the distance be between 4.0 mm and 25.0 mm.

The plug magnets 240 may be separated from an edge of the housing 234 by a distance 298, as shown in FIGS. 3-1 and 3-1. The plug magnets 240 start at an initial distance 298-1 from the housing 234. As the plug tip 232 approaches the magnetic receptacle 210, the plug magnets 240 transition to a final distance 298-2 from the housing. The initial distance 298-1 may include an upper value, a lower value, or upper and lower values including 4.0 mm, 10.0 mm, 15.0 mm, 25.0 mm, or any value therebetween. In some implementations, it may be critical that the distance be greater than 4.0 mm. The final distance 298-2 may include an upper value, a lower value, or upper and lower values including 0.0 mm, 1.0 mm, 2.0 mm, or any value therebetween. In some implementations, it may be critical that the distance be less than 2.0 mm.

The one or more latching features 236 may be connected to one or more latching feature arms 254. As shown, the first latching feature 236-1 is connected to the first latching feature arm 254-1 and the second latching feature 236-2 is connected to the second latching feature arm 254-2. The first latching feature 236-1 and the second latching feature 236-2 may be connected at a pivot point 256. The latching feature arms 254 may include a biasing element 238 (e.g., a spring) configured to bias the latching features 236 toward the engaged (e.g., friction) state (e.g., as shown in FIG. 3-1).

The latching feature actuator 250 may include an actuator wedge 252. The actuator wedge 252 may engage the one or more latching feature arms 254 to transition the one or more latching feature arms 254 toward and/or to the disengaged state (e.g., as shown in FIG. 3-2). For example, the actuating wedge 252 may include a wedging surface (not labeled) that engages a wedging surface (not labeled) of the one or more latching feature arms 254.

In the implementation shown in FIGS. 3-1 and 3-2 the first latching feature 236-1 and the second latching feature 236-2 are separated by a distance 294. The first latching feature 236-1 and the second latching feature 236-2 are separated by an engaged distance 294-1, as shown in FIG. 3-1, and are separated by a disengaged distance 294-2, as shown in FIG. 3-2. As shown, the engaged distance 294-1 is smaller than the disengaged distance 294-2 to move the latching features 236 outward.

As the magnetic plug 230 is moved toward the magnetic receptacle 210, magnetic fields from the receptacle magnets 220 and the plug magnets 240 may draw the magnetic plug 230 toward the magnetic receptacle 210. Drawing the magnetic plug 230 toward the magnetic receptacle 210 may include aligning the magnetic plug 230 so that it can be drawn into the magnetic receptacle 210 or simply drawing the magnetic plug 230 into the magnetic receptacle 210. Orientations of poles of the receptacle magnets 220 and/or the plug magnets 240 may facilitate aligning and/or drawing the magnetic plug 230 with and/or into the magnetic receptacle 210.

As the magnetic plug 230 gets closer to the magnetic receptacle 210, magnetic fields from the receptacle magnets 220 and the plug magnets 240 may activate the latching feature actuator 250 to transition the latching features 236 toward and/or to the disengaged state (e.g., as shown in FIG. 3-2). Activating the latching feature actuator 250 may include moving the latching feature actuator 250 toward the magnetic receptacle 210. Moving the latching feature actuator 250 toward the magnetic receptacle 210 may move the actuator wedge 252 toward the magnetic receptacle 210, which may move the latching feature arms 254 to move the latching features 236 toward and/or to the disengaged state.

As the magnetic plug 230 is moved out of the magnetic receptacle, the magnetic fields from the receptacle magnets 220 and the plug magnets 240 may weaken to transition the latching feature actuator 250 toward the engaged state (e.g., as shown in FIG. 3-1). As the distance between the receptacle magnets 220 and the plug magnets 240 increases, the magnetic fields continue to weaken such that the biasing element 238 urges the latching feature actuator 250 to transition the latching features 236 toward and/or to the engaged state (e.g., as shown in FIG. 3-1).

Deactivating the latching feature actuator 250 may include moving the latching feature actuator 250 away from the magnetic receptacle 210. Moving the latching feature actuator 250 away from the magnetic receptacle 210 may move the actuator wedge 252 away from the magnetic receptacle 210, which may allow the biasing element 238 to move the latching feature arms 254 to move the latching features 236 toward and/or to the disengaged state.

Activating a latching feature actuator may move one or more latching features within the magnetic receptacle 210 and/or magnetic plug 230 to create a "magnetic experience" without a "friction experience". In one or more implementations where only one of the plug or receptacle is a magnetic plug 230 or magnetic receptacle 210, the latching feature activator may not be actuated and the plug and/or receptacle experiences only a "friction experience."

One or more components of the implementation of FIGS. 1 and 2 may be incorporated into and/or replace one or more components of this second implementation. For example, receptacle magnets 220 and/or plug magnets 240 may be placed the locations of the receptacle magnets 120 and/or plug magnets 140.

Figures 2, 4:
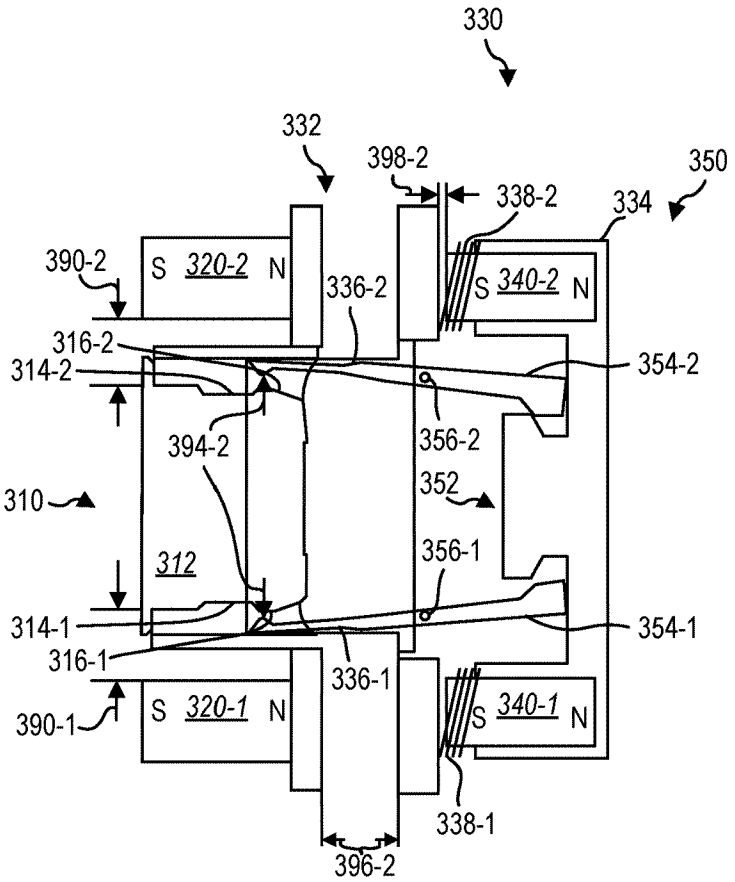
Figures 1, 4:
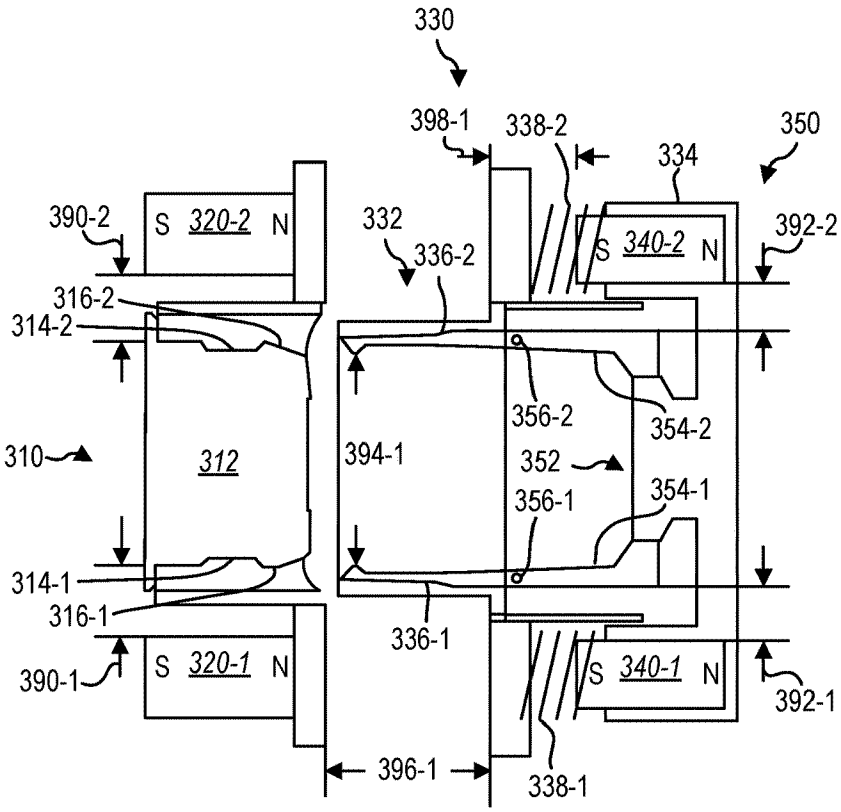

FIGS. 4-1 and 4-2 are cutaway schematic top views of an implementation of a magnetic receptacle 310 and an implementation of a magnetic plug 330, according to a third implementation of the present disclosure. FIG. 4-1 illustrates the magnetic plug 330 in an engaged state and FIG. 4-2 illustrates the magnetic plug 330 in a disengaged state. Referring generally to FIGS. 4-1 and 4-2, the magnetic receptacle 310 may be used with the computing device 100.

The magnetic receptacle 310 may include an electronic connector 312 and one or more receptacle magnets 320. The electronic connector 312 may include one or more engagement features 314 that may be configured to facilitate a "friction experience" with, a standard plug.

The magnetic plug 330 may include a plug tip 332 with one or more electrical connections (not labeled) to put the plug tip 332 in electrical and/or power communication with the magnetic receptacle 310 (or a standard receptacle). The magnetic plug 330 may include a housing 334 that encapsulates one or more electrical and/or mechanical components of the magnetic plug 330.

The plug tip 332 may include one or more latching features 336. The latching features 336 may be configured to facilitate a "friction experience" with a standard receptacle.

The housing 334 may house one or more plug magnets 340. The one or more plug magnets 340 may be connected to a latching feature actuator 350. The latching feature may be similar to the latching feature actuator 250. For example, the latching feature actuator 350 may move the one or more latching features 336 toward and/or to a disengaged state (e.g., as shown in FIG. 4-2). In the disengaged state, the one or more latching features 336 may be moved so that they do not engage the one or more engagement features 314 when inserted.

As shown in FIG. 4-1, the latching features 336 may be in an engaged state at a distance 396-1 between an outer surface of the magnetic receptacle 310 and a base of the plug tip 332. As shown in FIG. 4-2, the latching features 336 may be in a disengaged state at a distance 396-2 between the outer surface of the magnetic receptacle 310 and the base of the plug tip 332. The distance 396 may include an engaged distance, a disengaged distance, and distances where the latching feature actuator 350 transitions between the engaged and disengaged states. The engaged distance, disengaged distance, and the transition distance may include values provided above.

The plug magnets 340 may be separated from an edge of the housing 334 by a distance 398, as shown in FIGS. 4-1 and 4-1. The plug magnets 340 start at an initial distance 398-1 from the housing 334. As the plug tip 332 approaches the magnetic receptacle 310, the plug magnets 340 transition to a final distance 398-2 from the housing. The initial distance 398-1 and final distance 398-2 may include values provided above.

The one or more receptacle magnets 320 may be separated from a side 316 of an engagement feature 314 of the electronic connector 312 by a distance 390 and the one or more plug magnets 340 may be separated from the one or more latching features 336 by a distance 392, as described above.

The one or more latching features 336 may be connected to one or more latching feature arms 354. The one or more latching feature arms 354 may be similar to the latching feature arms 254 described and shown in connection with FIGS. 3-1 and 3-2. Unlike the latching feature arms 254, the latching feature arms 354 are each connected to an individual pivot point 356. For example, the first latching feature 336-1 is connected to the first latching feature arm 354-1 and to the first pivot point 356-1 and the second latching feature 336-2 is connected to the second latching feature arm 354-2 and to the second pivot point 356-2. The latching feature arms 354 may include a biasing element 338 configured to bias the latching features 336 toward the engaged (e.g., friction) state (e.g., as shown in FIG. 4-1). For example, the first latching feature arm 354-1 may have a biasing element (not labeled) about the first pivot point 356-1 and the second latching feature arm 354-2 may have a biasing element (not labeled) about the second pivot point 356-2.

Similar to the latching feature actuator 250, the latching feature actuator 350 may include an actuator wedge 352. The actuator wedge 352 may engage the one or more latching feature arms 354 to transition the one or more latching feature arms 354 toward and/or to the disengaged state (e.g., as shown in FIG. 4-2). For example, the actuating wedge 352 may include a wedging surface (not labeled) that engages a wedging surface (not labeled) of the one or more latching feature arms 354.

In the implementation shown in FIGS. 4-1 and 4-2, the first latching feature 336-1 and the second latching feature 336-2 are separated by a distance 394. The first latching feature 336-1 and the second latching feature 336-2 are separated by an engaged distance 394-1, as shown in FIG. 4-1, and are separated by a disengaged distance 394-2, as shown in FIG. 4-2. As shown, the engaged distance 394-1 is smaller than the disengaged distance 394-2 to move the latching features 336 outward.

Similar to the latching feature actuator 250 of FIGS. 3-1 and 3-2, the latching feature actuator 350 of FIGS. 4-1 and 4-2 may be biased away from the plug tip by one or more biasing elements 338. As the magnetic plug 330 is moved toward the magnetic receptacle 310, magnetic fields from the receptacle magnets 320 and the plug magnets 340 may draw the magnetic plug 330 toward the magnetic receptacle 310. Drawing the magnetic plug 330 toward the magnetic receptacle 310 may include aligning the magnetic plug 330 so that it can be drawn into the magnetic receptacle 310 or simply drawing the magnetic plug 330 into the magnetic receptacle 310. Orientations of poles of the receptacle magnets 320 and/or the plug magnets 340 may facilitate aligning and/or drawing the magnetic plug 330 with and/or into the magnetic receptacle 310.

As the magnetic plug 330 gets closer to the magnetic receptacle 310, magnetic fields from the receptacle magnets 320 and the plug magnets 340 may activate the latching feature actuator 350 to transition the latching features 336 toward and/or to the disengaged state (e.g., as shown in FIG. 4-2). Activating the latching feature actuator 350 may include moving the latching feature actuator 350 toward the magnetic receptacle 310. Moving the latching feature actuator 350 toward the magnetic receptacle 310 may move the actuator wedge 352 toward the magnetic receptacle 310, which may allow the latching feature arms 354 to rotate the latching features 336 toward and/or to the disengaged state. For example, the first latching feature arm 354-1 and the second latching feature arm 354-2, as shown in FIG. 4-2, rotates from the engaged state of FIG. 4-1 toward and/or to the disengaged state of FIG. 4-2 due to the biasing elements on the pivots points 356-1, 356-2.

As the magnetic plug 330 is moved out of the magnetic receptacle, the magnetic fields from the receptacle magnets 320 and the plug magnets 340 may weaken to transition the latching feature actuator 350 toward the engaged state (e.g., as shown in FIG. 4-1). As the distance between the receptacle magnets 320 and the plug magnets 340 increases, the magnetic fields continue to weaken such that the one or more biasing elements 338 urge the latching feature actuator 350 to transition the latching features 336 toward and/or to the engaged state (e.g., as shown in FIG. 4-1).

Deactivating the latching feature actuator 350 may include moving the latching feature actuator 350 away from the magnetic receptacle 310. Moving the latching feature actuator 350 away from the magnetic receptacle 310 may move the actuator wedge 352 away from the magnetic receptacle 310, which may move the latching feature arms 354 to move the latching features 336 toward and/or to the disengaged state.

Activating a latching feature actuator may move one or more latching features within the magnetic receptacle 310 and/or magnetic plug 330 to create a "magnetic experience" without a "friction experience". In one or more implementations where only one of the plug or receptacle is a magnetic plug 330 or magnetic receptacle 310, the latching feature activator may not be actuated and the plug and/or receptacle experiences only a "friction experience."

One or more components of the implementation of FIGS. 1, 2, 3-1 and 3-1 may be incorporated into and/or replace one or more components of this third implementation. For example, receptacle magnets 320 and/or plug magnets 340 may be placed the locations of the receptacle magnets 120 and/or plug magnets 140. In another example, the first and second pivot points 356-1, 356-2 and the first and second latching feature arms 354-1, 354-2 may be replaced with a single pivot point 256 and first and second latching feature arms 254-1, 254-2.

Figures 2, 5:
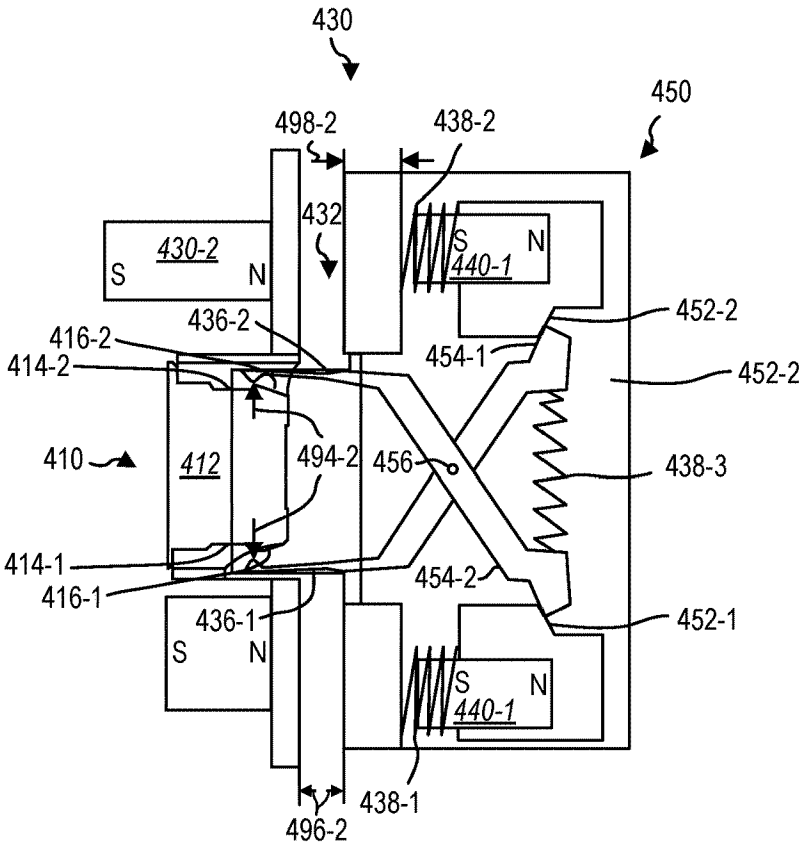
Figures 1, 5:
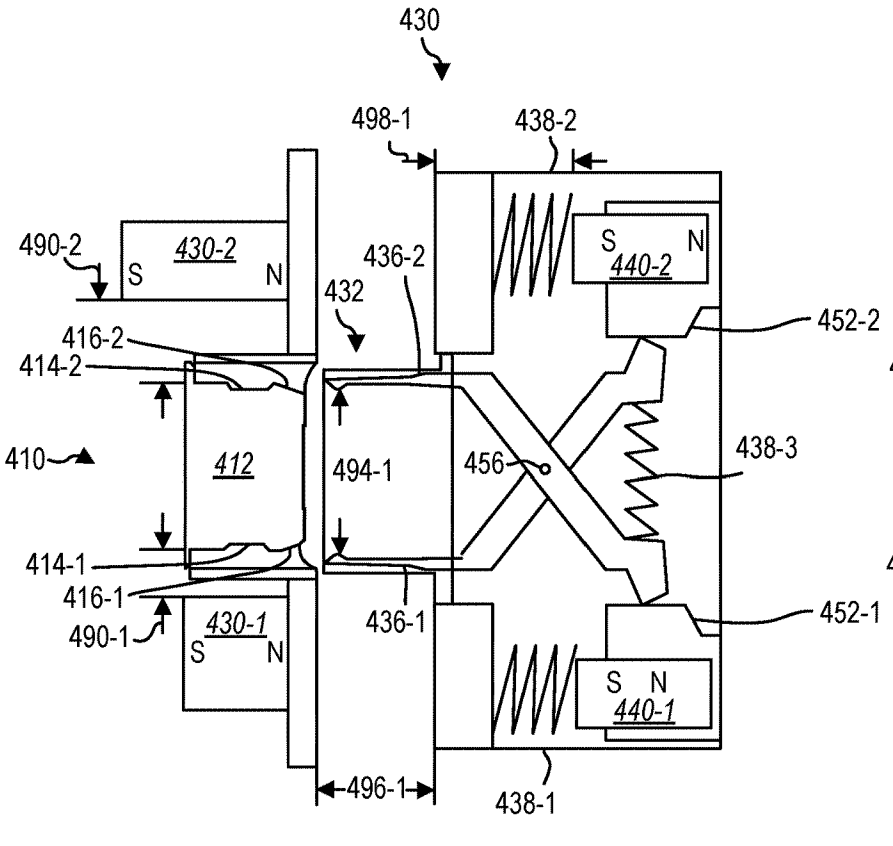

FIGS. 5-1 and 5-2 are cutaway schematic top views of an implementation of a magnetic receptacle 410 and an implementation of a magnetic plug 430, according to a fourth implementation of the present disclosure. FIG. 5-1 illustrates the magnetic plug 430 in an engaged state and FIG. 5-2 illustrates the magnetic plug 430 in a disengaged state. Referring generally to FIGS. 5-1 and 5-2, the magnetic receptacle 410 may be used with the computing device 100.

The magnetic receptacle 410 may include an electronic connector 412 and one or more receptacle magnets 420. The electronic connector 412 may include one or more engagement features 414 that may be configured to facilitate a "friction experience" with a standard plug.

The magnetic plug 430 may include a plug tip 432 with one or more electrical connections (not labeled) to put the plug tip 432 in electrical and/or power communication with the magnetic receptacle 410 (or a standard receptacle). The magnetic plug 430 may include a housing 434 that encapsulates one or more electrical and/or mechanical components of the magnetic plug 430.

The plug tip 432 may include one or more latching features 436. The latching features 436 may be configured to facilitate a "friction experience" with a standard receptacle.

The housing 434 may house one or more plug magnets 440. The one or more plug magnets 440 may be connected to a latching feature actuator 450. The latching feature may be similar to the latching feature actuator 250. For example, the latching feature actuator 450 may move the one or more latching features 436 toward and/or to a disengaged state (e.g., as shown in FIG. 5-2).

As shown in FIG. 5-1, the latching features 436 may be in an engaged state at a distance 496-1 between an outer surface of the magnetic receptacle 410 and a base of the plug tip 432. As shown in FIG. 5-2, the latching features 436 may be in a disengaged state at a distance 496-2 between the outer surface of the magnetic receptacle 410 and the base of the plug tip 432. The distance 496 may include an engaged distance, a disengaged distance, and distances where the latching feature actuator 450 transitions between the engaged and disengaged states. The engaged distance, disengaged distance, and the transition distance may include values provided above.

The plug magnets 440 may be separated from an edge of the housing 434 by a distance 498, as shown in FIGS. 5-1 and 5-1. The plug magnets 440 start at an initial distance 498-1 from the housing 434. As the plug tip 432 approaches the magnetic receptacle 410, the plug magnets 440 transition to a final distance 498-2 from the housing. The initial distance 498-1 and final distance 498-2 may include values provided above.

The one or more receptacle magnets 420 may be separated from a side 416 of an engagement feature 414 of the electronic connector 412 by a distance 490 and the one or more plug magnets 440 may be separated from the one or more latching features 436 by a distance 492, as described above.

The one or more latching features 436 may be connected to one or more latching feature arms 454. The one or more latching feature arms 454 may be similar to the latching feature arms 254 described and shown in connection with FIGS. 4-1 and 4-2. Like the latching feature arms 254, the latching feature arms 454 are both connected to an individual pivot point 456. Unlike the latching feature arms 254 of FIGS. 3-1 and 3-2, the latching feature arms 454 have a biasing element 438-3 that biases the latching feature arms 454 toward the disengaged state. (e.g., as shown in FIG. 5-2).

Unlike the latching feature actuator 250, the latching feature actuator 450 may include a plurality of actuator wedges 452. Each actuator wedge 452 may engage the one or more latching feature arms 454 to hold the one or more latching feature arms 454 in the engaged state and when moved allow the latching feature arms 454 to transition toward and/or to the disengaged state (e.g., as shown in FIG. 5-2).

In the implementation shown in FIGS. 5-1 and 5-2, the first latching feature 436-1 and the second latching feature 436-2 are separated by a distance 494. The first latching feature 436-1 and the second latching feature 436-2 are separated by an engaged distance 494-1, as shown in FIG. 5-1, and are separated by a disengaged distance 494-2, as shown in FIG. 5-2. As shown, the engaged distance 494-1 is smaller than the disengaged distance 494-2 to move the latching features 436 outward.

Similar to the latching feature actuators 250, 350 of FIGS. 3-1 and 3-2 and FIGS. 4-1 and 4-2, the latching feature actuator 450 of FIGS. 5-1 and 5-2 may be biased away from the plug tip by one or more biasing elements 438 (e.g., first biasing element 438-1 and second biasing element 438-2). As the magnetic plug 430 is moved toward the magnetic receptacle 410, magnetic fields from the receptacle magnets 420 and the plug magnets 440 may draw the magnetic plug 430 toward the magnetic receptacle 410. Drawing the magnetic plug 430 toward the magnetic receptacle 410 may include aligning the magnetic plug 430 so that it can be drawn into the magnetic receptacle 410 or simply drawing the magnetic plug 430 into the magnetic receptacle 410. Orientations of poles of the receptacle magnets 420 and/or the plug magnets 440 may facilitate aligning and/or drawing the magnetic plug 430 with and/or into the magnetic receptacle 410.

As the magnetic plug 430 gets closer to the magnetic receptacle 410, magnetic fields from the receptacle magnets 420 and the plug magnets 440 may activate the latching feature actuator 450 to transition the latching features 436 toward and/or to the disengaged state (e.g., as shown in FIG. 5-2). Activating the latching feature actuator 450 may include moving the latching feature actuator 450 toward the magnetic receptacle 410. Moving the latching feature actuator 450 toward the magnetic receptacle 410 may move the one or more actuator wedges 452 toward the magnetic receptacle 410, which may allow the latching feature arms 454 to rotate the latching features 436 toward and/or to the disengaged state. For example, the first latching feature arm 454-1 and the second latching feature arm 454-2, as shown in FIG. 5-2, rotates from the engaged state of FIG. 5-1 toward and/or to the disengaged state of FIG. 5-2 due to the biasing element 438-3.

As the magnetic plug 430 is moved out of the magnetic receptacle, the magnetic fields from the receptacle magnets 420 and the plug magnets 440 may weaken to transition the latching feature actuator 450 toward the engaged state (e.g., as shown in FIG. 5-1). As the distance between the receptacle magnets 420 and the plug magnets 440 increases, the magnetic fields continue to weaken such that the one or more biasing elements 438 urge the latching feature actuator 450 to transition the latching features 436 toward and/or to the engaged state (e.g., as shown in FIG. 5-1).

Deactivating the latching feature actuator 450 may include moving the latching feature actuator 450 away from the magnetic receptacle 410. Moving the latching feature actuator 450 away from the magnetic receptacle 410 may move the actuator wedge 452 away from the magnetic receptacle 410, which may move the latching feature arms 454 to move the latching features 436 toward and/or to the disengaged state.

Activating a latching feature actuator may move one or more latching features within the magnetic receptacle 410 and/or magnetic plug 430 to create a "magnetic experience" without a "friction experience". In one or more implementations where only one of the plug or receptacle is a magnetic plug 430 or magnetic receptacle 410, the latching feature activator may not be actuated and the plug and/or receptacle experiences only a "friction experience."

One or more components of the implementation of FIGS. 1, 2, 3-1 and 3-2, and 4-1 and 4-1 may be incorporated into and/or replace one or more components of this fourth implementation. For example, receptacle magnets 420 and/or plug magnets 440 may be placed the locations of the receptacle magnets 120 and/or plug magnets 140. In another example, the one or more actuator wedges 452 may be used with the one or more latching features 336 of FIG. 4, where the latching feature arms 354 are biased outward.

Although the implementations described above illustrate engagement and disengagement of the latching features by rotation of the latching features, in other implementations, the latching features may slide along a track. For example, the latching features 236, 336, 436 may not rotate, but rather may slide away from each other, such that the distances 294, 394, 494 grow from the engaged to the disengaged state. Although the implementations described above illustrate a latching features and latching feature actuators on only the magnetic plugs, in some implementations, the latching features and latching feature actuators may be located on the magnetic receptacles and/or the magnetic plugs.

In at least one implementation, the "magnetic experience" and/or "friction experience" can be achieved without any adapters, and with standard mating features on the latched parts. Although, the description above generally describes the plug as having one or more latching features, in some implementations, the receptacle may include one or more latching features.

In at least one implementation, the latching feature actuators may reduce the "friction experience" while also creating a "magnetic experience." For example, the one or more latching features may be moved outward such that they still touch the engaging features of the receptacle, but with less force than in an initial position.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one implementation" or "an implementation" of the present disclosure are not intended to be interpreted as excluding the existence of additional implementations that also incorporate the recited features. For example, any element described in relation to an implementation herein may be combinable with any element of any other implementation described herein. Numbers, percentages, ratios, or other values stated herein are intended to include that value, and also other values that are "about" or "approximately" the stated value, as would be appreciated by one of ordinary skill in the art encompassed by implementations of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to implementations disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the implementations that falls within the meaning and scope of the claims is to be embraced by the claims.

It should be understood that any directions or reference frames in the preceding description are merely relative directions or movements. For example, any references to "front" and "back" or "top" and "bottom" or "left" and "right" are merely descriptive of the relative position or movement of the related elements.

The present disclosure may be embodied in other specific forms without departing from its spirit or characteristics. The described implementations are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A magnetic receptacle, comprising:

an electronic connector having an engagement feature on one or more sides of the electronic connector, the engagement feature configured to engage a latching feature on a magnetic protrusion; and one or more receptacle magnets positioned adjacent the magnetic receptacle configured to laterally move the latching feature on the magnetic protrusion.

2. The magnetic receptacle of claim 1, further comprising two engagement features on the electronic connector.

3. The magnetic receptacle of claim 1, wherein the one or more receptacle magnets includes a first receptacle magnet on a first side of the electronic connector and a second receptacle magnet on a second side of the electronic connector.

4. The magnetic receptacle of claim 1, the one or more receptacle magnets each generating a force of greater than an opposing force applied by a plug.

5. The magnetic receptacle of claim 1, the one or more receptacle magnets each generating a force of greater than 2.0 Newtons.

6. The magnetic receptacle of claim 1, further comprising one or more latching features with the magnetic receptacle.

7. The magnetic receptacle of claim 1, the one or more receptacle magnets positioned a distance from the electronic connector.

8. The magnetic receptacle of claim 7, the distance between the one or more receptacle magnets and the electronic connector being less than 5.0 millimeters.

9. A magnetic plug, comprising:

a plug tip;

one or more latching features; and one or more plug magnets positioned adjacent the plug tip, the one or more plug magnets configured to cooperate with one or more receptacle magnets to laterally move the one or more latching features between an engaged state and a disengaged state.

10. The magnetic plug of claim 9, wherein the one or more latching features includes a first latching feature and a second latching feature.

11. The magnetic plug of claim 9, wherein the one or more plug magnets includes a first plug magnet on a first side of the plug tip and a second plug magnet on a second side of the plug tip.

12. The magnetic plug of claim 9, the one or more plug magnets each generating a force of greater than 2.0 Newtons.

13. The magnetic plug of claim 9, wherein the one or more latching features are biased toward the engaged state.

14. The magnetic plug of claim 9, further comprising a latching feature actuator connected to the one or more plug magnets and to the one or more latching features.

15. The magnetic plug of claim 14, wherein the latching feature actuator is directly connected to the one or more plug magnets.

16. The magnetic plug of claim 14, wherein the latching feature actuator includes one or more springs to bias the one or more latching features toward the engaged state.

17. The magnetic plug of claim 14, wherein the latching feature actuator includes one or more pivots to pivot the one or more latching features between the engaged state and the disengaged state.

18. The magnetic plug of claim 9, the one or more plug magnets positioned a distance from the one or more latching features.

19. The magnetic plug of claim 18, the distance between the one or more plug magnets and the one or more latching features being less than 5.0 millimeters.

20. A system, comprising:

a magnetic receptacle including:

an electronic connector having an engagement feature on one or more sides of the electronic connector; and one or more receptacle magnets positioned adjacent the magnetic receptacle;

a magnetic plug including:

a plug tip;

one or more latching features; and one or more plug magnets positioned adjacent the plug tip, the one or more plug magnets configured to cooperate with the one or more receptacle magnets to laterally move the one or more latching features on the magnetic plug between a friction state and a free state.

* * * * *